United States Patent [19]

Dufour

[11] Patent Number: 4,754,561

[45] Date of Patent: Jul. 5, 1988

[54] GOLF SHOE

[75] Inventor: Pierre Dufour, Annecy, France

[73] Assignee: Salomon S.A., Annecy Cedex, France

[21] Appl. No.: 48,206

[22] Filed: May 11, 1987

[30] Foreign Application Priority Data

May 9, 1986 [FR] France ..... 86 07102

[51] Int. Cl.[4] ..... A43B 5/00; A43C 15/02

[52] U.S. Cl. ..... 36/127; 36/31; 36/59 C

[58] Field of Search ..... 36/28, 30 R, 30 A, 31, 36/59 R, 59 B, 59 C, 103, 113, 114, 124, 127, 134

[56] References Cited

U.S. PATENT DOCUMENTS

| | | | |
|---|---|---|---|
| 2,616,190 | 11/1952 | Darby | 36/25 R X |
| 2,847,769 | 8/1958 | Schlesinger | 36/127 |
| 2,855,704 | 10/1958 | Schlesinger | 36/25 R X |
| 3,593,436 | 7/1971 | Vietas | 36/59 C X |
| 4,506,462 | 3/1985 | Cavagnagh | 36/31 X |
| 4,547,979 | 10/1985 | Harada et al. | 36/31 X |
| 4,642,911 | 2/1987 | Talarico | 36/30 R |
| 4,685,227 | 8/1987 | Simmons | 36/127 |

*Primary Examiner*—Donald Watkins

*Attorney, Agent, or Firm*—Pollock, Vande Sande & Priddy

[57] ABSTRACT

Golf shoe (1), the sole (2) of which has two separate areas (3) and (4), one of which (4) is provided with a shock absorbing element (5) and a deformable structure (6) to allow the golfer's foot to roll on the outer edge of the sole.

21 Claims, 4 Drawing Sheets

GOLF SHOE

FIELD OF THE INVENTION

This invention pertains to golf shoes, and especially a shoe sole able to facilitate the rolling of the foot (the left foot for a left-handed person; the right for a right-handed person) during the golfer's swing movement; the term "swing" indicates the kinematics of the golfer's compound movements in order to hit the ball.

BACKGROUND OF THE INVENTION

Many golf shoes are known in which the sole of the left shoe (for example) is provided with an inclined plane on the side corresponding to its outer left edge; this type of arrangement makes possible the lateral rolling of the foot on the side of the outer edge during the swing and the relative stabilization thereof when the movement is completed. These shoes also very often have a certain number of spikes under the sole to ensure a good degree of traction with the ground. However, this type of shoe is found to be uncomfortable during the execution of the swing because no shock absorption is provided for the foot inside the shoe, specifically in the zone of support corresponding to the outer left edge of the sole, a zone subjected to very high momentary pressure.

Other known golf shoes such as that described in German Utility Certificate GbM No. 85366706 are provided with soles which protrude largely from the upper, on the side of the left outer edge, to allow the foot to roll by the elastic deformation of these parts of the sole. Indeed, the foot is rolled more progressively than in the case of an inclined plane as seen above. Nonetheless, it remains that this type of sole, still of relative comfort, substantially modifies the "seating" of the feet on the ground, which causes certain problems in the golfer's movements.

Other shoes can be cited as examples, as described in U.S. Pat. No. 4,506,462 and in French Patent Applications FR No. 2 522 482 and FR No. 2 553 636; these shoes have soles comprised of several elements or inserts, juxtaposed and/or attached, having different shock absorbing characteristics. If they provide greater comfort than those mentioned above, these shoes are designed above all for walking and make possible the correct rolling of the foot on the outer edge of the sole, which renders them unsuitable for golfing.

SUMMARY OF THE INVENTION

This invention proposes a golf shoe which provides excellent comfort for the foot, especially during the swing, and allows a rolling of the foot on the outer edge of the sole which has no adverse effects on the sound contact with the ground during the movement. Generally, a left shoe, thus a shoe for right-handed golfers, which represent 90% of the players, will be discussed.

The golf shoe according to the invention is characterized by the fact that the sole has two separate support parts or zones for the foot; a first, "passive" part or zone which constitutes the main seating for the foot is made of a material having a certain hardness, and a second, "active" part or zone, which is provided with a shock absorbing element on the side of the foot, and this element is made of a softer material than that of the "passive" zone; the shock absorbing element, with the first support zone, is connected in a continuous manner to a structure which can deform transversely to the longitudinal axis of the sole. The "active" part or zone is placed in the sole to absorb the pressure of the golfer's foot during the swing and for this purpose covers a surface which coincides at least substantially with the 3rd, 4th and 5th metatarsals and the corresponding first phalanges of the foot; this is the part in which the pressure of the foot becomes greatest and with which the deformable structure to facilitate the rolling of the foot on the left outer edge of the sole must be associated; this structure consists, for example, of a tapered extension of the first passive support zone, which extends under a shock absorbing element located under the second active zone, and the shock absorbing element is in the form of an insert which occupies the space left open above the tapered area, continuous with said first zone. It is clearly understood that the tapering shall be determined as a function of the transverse flexibility to be obtained in light of the characteristics of the materials comprising the shock absorbing element and/or the two respective parts or zones of the sole.

Without departing from the scope of the invention, it is also possible to provide an outsole to which both support parts or zones of the sole are attached; the transverse flexibility characteristics of the latter shall in this case be dependent on those of the material comprising the outsole and the active shock absorbing part or zone.

According to another embodiment of the sole, still according to the invention, the passive support zone extends over the entire thickness of the sole and the active support zone adjacent thereto, as well as the shock absorbing element, rest on another element of the sole connected to the aforementioned first two zones.

Other embodiments of the deformable structure consist of a succession of grooves or slits made in the sole on the side of the walking surface; these grooves can be parallel to each other as well as to the longitudinal axis of the sole and extend at least over all or part of the "active" zone. These grooves may also be sinuous. Of course, these grooves or slits as just described may be associated with the various deformable structures described in the examples above.

Finally, it is possible to provide the left outer edge of the sole with a plane which is inclined or rounded in the "rolling" direction of the foot.

Moreover, since the shoe according to the invention is intended more specifically for golfing, the walking surface of the sole will advantageously be provided with gripping means such as spikes or projecting parts suitable to ensure a sound anchoring with the ground during the swing; according to one preferred embodiment, these gripping means shall be distributed more densely under the active support zone of the sole.

Additional modifications can obviously be made in golf shoe soles described using the various embodiments above. Thus, for example, the sole may have a transverse section such that the general transverse support of the foot inside the shoe is substantially parallel to the walking surface thereof. Also, the internal support of the foot in a transverse direction may be provided in an inclined manner possible to promote supports for the feet with respect to the ground during the first phase called the "address" of the swing; in such a case, the inclination is oriented moving upward from the inside of the foot to the outside. Other embodiments can combine several arrangements of this type and, for example, propose a sole whose inside transverse support for the foot in the shoe is parallel to the walking surface in the heel area, progressively reaching a transverse support inclined at the level of the support zones for the front of the foot.

BRIEF DESCRIPTION OF THE DRAWINGS

The golf shoe which is the object of the invention will be understood more clearly by consulting the detailed description which follows with reference to the attached schematic drawings providing examples of various embodiments thereof, and of which:

FIG. 11 is a perspective view of the sole, and FIG. 12 is a cross section along line XII—XII of this sole;

DESCRIPTION OF THE PREFERRED EMBODIMENTS

As explained above, a left shoe, thus a shoe especially for right-handed players, is preferably described; of course, the characteristics presented below can be applied to a right shoe, which thus will be for left-handed golfers (about 10%), without departing from the framework of the invention.

Figure 1:
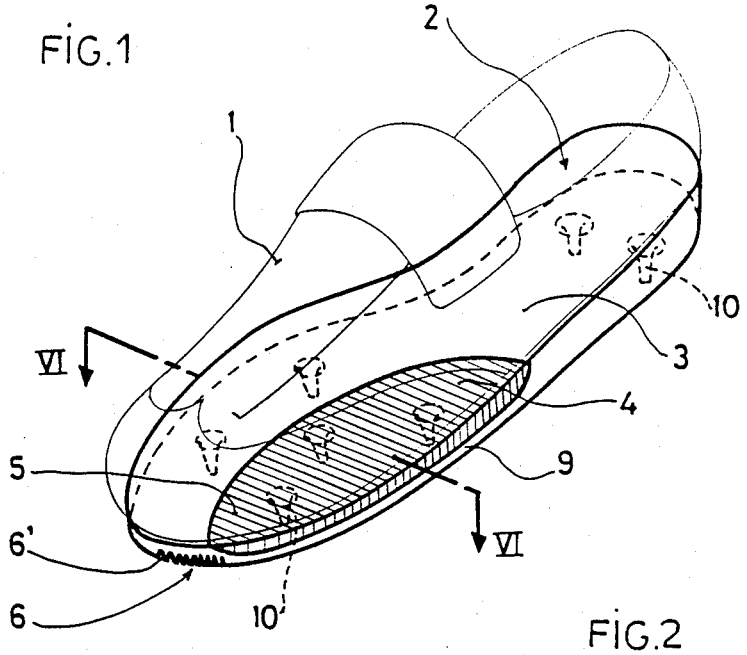
FIG. 1 is a perspective view of the shoe.
Figure 2:
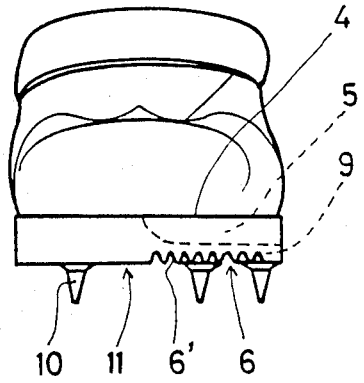
FIG. 2 is an elevation view of the front of the shoe.
Figure 3:
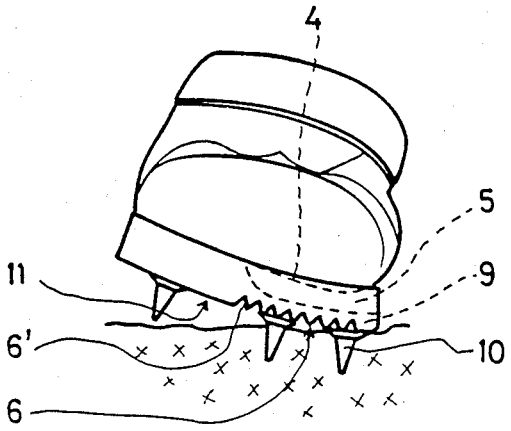
FIG. 3 is an elevation view of the front of the shoe shown schematically in a "rolling" position of the foot during the swing.
Figure 4:
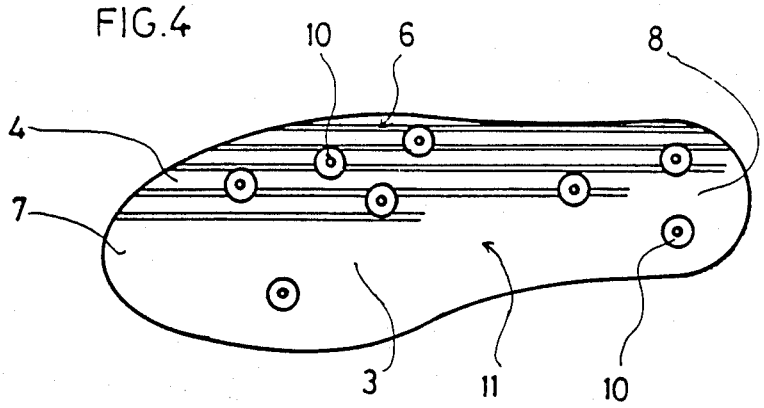
FIG. 4 is a bottom view of the sole of the shoe.

As can be seen in FIG. 1, the golf shoe is shown in a transparent manner to better display the details of the construction of the sole 2. This sole has two separate zones, respectively 3 and 4, intended to accommodate and support the golfer's left foot. According to the invention, the first 3 of these zones extends under most of the foot, from the heel to the front end of the sole, while the second zone 4 covers only a small surface located substantially connected to the place occupied by the 3rd, 4th and 5th metatarsals and respective first phalanges of the golfer's foot. The "passive" zone 3 constitutes the main seating for the foot and is made of a material having a certain hardness, while the "active" zone 4 is comprised, on the one hand, of a shock absorbing element 5 essentially corresponding to the zone 4, which is made of a softer material and, on the other hand, a structure 6 which can deform transversely to the longitudinal axis of the sole 2. FIGS. 1 to 4 show that this structure 6 is associated with the active zone 4 in order to give the latter more transverse flexibility when the golfer applies pressure to the outer left part of his left foot during the swing. This is also shown in FIG. 3. In this embodiment, this transverse flexibility is obtained using a series of grooves 6' extending approximately parallel to the longitudinal axis of the sole from the front part 7 thereof to the heel 8, over at least part of active zone 4 and by means of the tapering 9 of the passive zone 3 which supports the shock absorbing element 5. Spikes 10 are then advantageously fastened to the sole 2 on the side of the walking surface 11 to ensure solid traction with the ground; the density of the distribution of the spikes 10 preferably differs depending on whether they are placed in the passive or active zones, respectively 3 and 4, of the sole. Thus, the active zone 4 has a greater density of spikes 10 than the passive zone 3.

Figure 5:
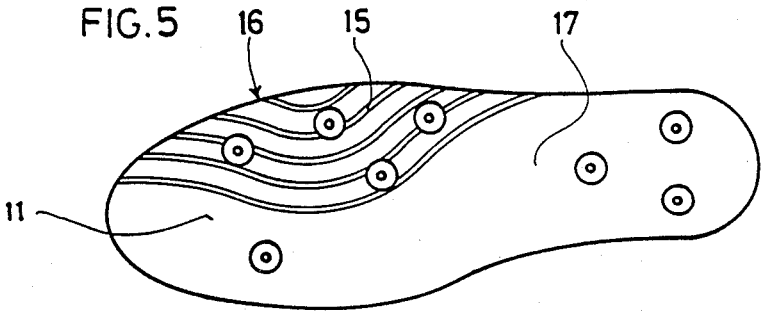
FIG. 5 shows another embodiment of the sole of the shoe in FIG. 1.

In another embodiment of the sole with deformable structure shown in FIG. 5, the grooves 15 have a sinuous shape and have in their center part a portion substantially forming circle arcs approximately concentric to each of the metatarsal heads. These grooves are next secant to the outer edge 16 of the sole 17.

Figure 6:
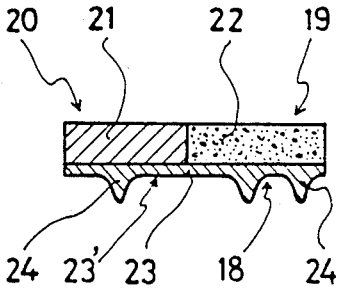

FIG. 6 shows a cross section along line VI—VI in FIG. 1 of the transverse structure of a sole 20 of a golf shoe. In this embodiment, the shock absorbing element 22 of the active zone 19 is juxtaposed with the passive zone 21 while the deformable structure 18 is comprised of a relatively flexible outsole 23 having on the walking surface 23 projections 24 made as a unit with said sole 23. In this case, the outsole 23 and its projections 24 will be molded by injecting a single material.

Figure 7:
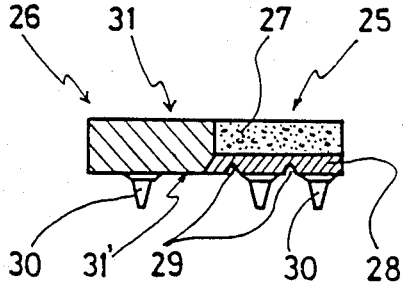
FIGS. 6 to 9 are cross section views along line VI—VI in FIG. 1 and show details of several structures and assemblies of a golf shoe sole, still according to the invention.

FIG. 7 illustrates a sole 31 in which the active zone 25 comprises a composite structure, while the passive zone 26 is made of one component. In this example, the active zone 25 is comprised of one portion of the outsole 28, having grooves 29, and the shock absorbing element 27, with the portion of the sole 28 and the shock absorbing element 27 being fastened to the passive zone 26 using any known means or process such as gluing, sewing, soldering, etc. Spikes 30 are also provided in this area, screwed to the walking surface 31 extending from the passive zone 26 to the sole portion 28.

Figure 8:
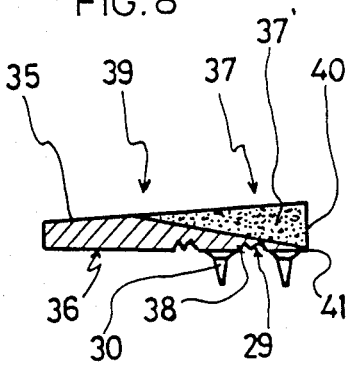

As can be seen in FIG. 8, the passive zone 35 extends under the entire walking surface 36 as in the example described above in FIGS. 1 to 4, but the tapering 38 is done in a more progressive manner, from the right inner part of the sole 39 to the left outer edge 40, following an oblique line which meets the lower angle 41 of said edge 40, under the active zone 37 endowed with a shock absorbing element 37'.

Figure 9:
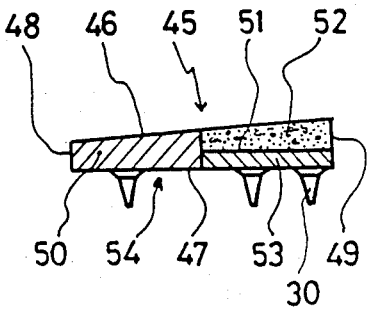

Still according to the invention (FIG. 9), the sole 45 has a transverse section in which the inside support surface 46 is inclined with respect to the walking surface 47. Considering that this involves the sole 45 of a left shoe, the incline of the surface 46 rises from the right inner edge 48 of said sole to the outer edge 49 thereof. The structure of this sole 45 shows a passive zone 50, one part 54 of which serves as a walking surface, and an active zone 51; the latter is comprised of a shock absorbing element 52 and a walking sole portion 53 corresponding to said element; in this embodiment, the portion of the walking sole 53 has a relative flexibility which, associated with that of the shock absorbing element 52, determines at least in the transverse direction the shock absorbing and deformability characteristics of the sole 45.

Figure 10:
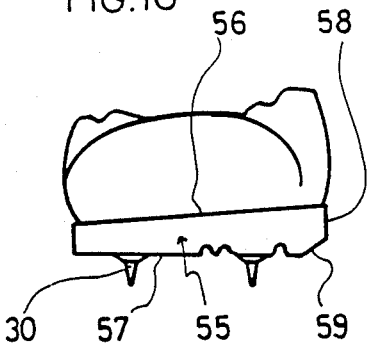
FIG. 10 is an elevation view of the front of a golf shoe according to one embodiment of the sole.

As assembled in FIG. 10, the sole 55 transversely has a plantar support surface 56 for the foot, providing the latter with a seating inclined with respect to the walking surface 57, as described above in reference to FIG. 9; conversely, in order to facilitate the rolling of the foot on the left outer edge 58 of the sole 55, an inclined plane 59, secant to the walking surface 57, is made on the lower side of said edge 58.

Figure 12:
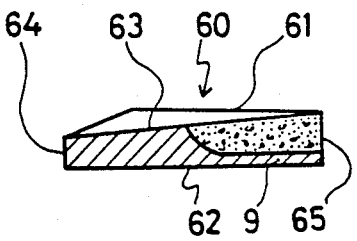
FIGS. 11 and 12 schematically present another embodiment of the sole which is the object of the invention.
Figure 11:
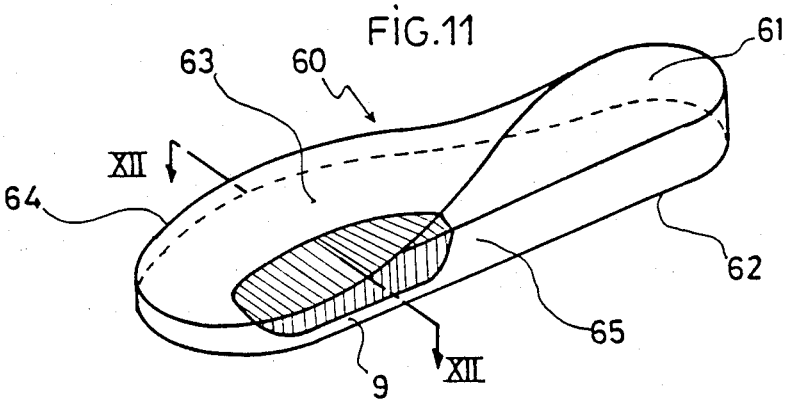

Provision is also made (FIGS. 11 and 12) for the sole 60 to furnish a transverse seating for the foot, having variations in the plantar support surface. As such, the plantar support zone 61 at the level of the heel remains substantially parallel to the walking surface 62, while the support surface 63 in the front area of the foot is inclined upwards from the inner edge 64 towards the outer edge 65.

Figure 13:
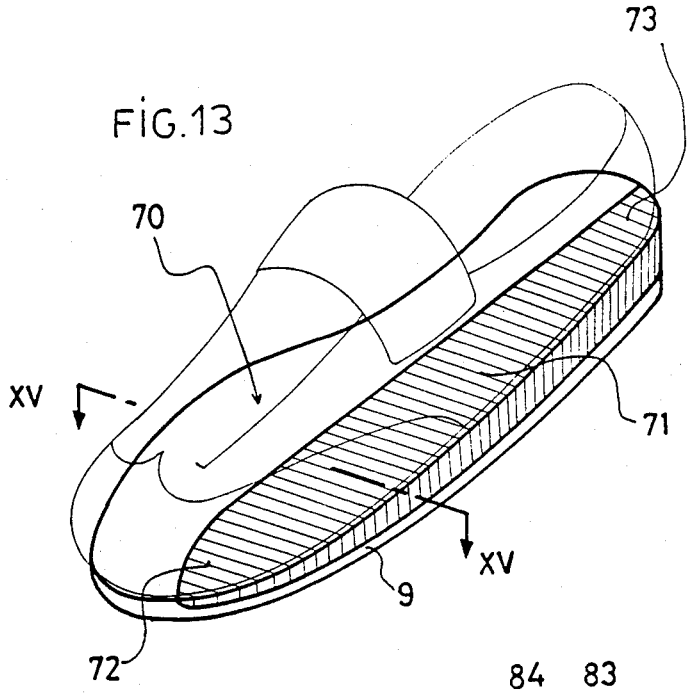
FIG. 13 shows an embodiment of the golf shoe sole in which the shock absorbing zone extends from the front of the foot to the heel.

According to another embodiment, illustrated in FIG. 13, the sole 70 is provided with a shock absorbing element 71 which extends substantially from the front part 72 occupied by the 3rd, 4th and 5th phalanges of the foot up to the heel zone 73; this element 71 has a variable thickness so that the front part 72 is thinner than the part at the heel 73. In this example, the thickness of the sole 70, seen in elevation in its longitudinal direction, also increases as it goes towards the heel zone 73.

Figure 14:
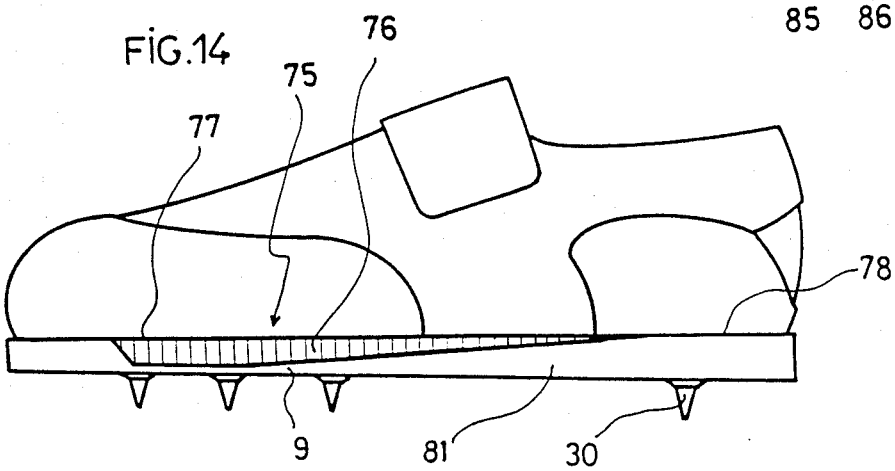
FIG. 14 is a lateral elevation view of a golf shoe in which the shock absorbing zone extends, tapering progressively up to the area near the heel.

Finally, another embodiment of the sole 75, illustrated by FIG. 14, teaches a relatively constant thickness in the direction of its length, while the shock absorbing element 76 has a thickness which decreases progressively from the front part 77 occupied by the 3rd, 4th and 5th first phalanges of the foot up to the heel 78.

Figure 15:
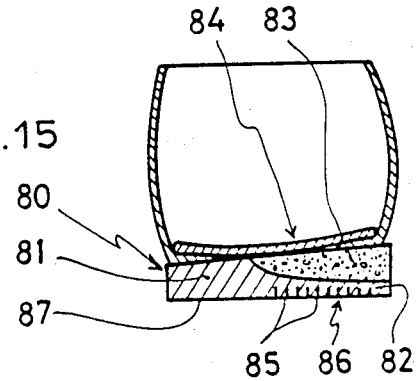
FIG. 15 is a cross section view along line XV—XV of the sole in FIG. 13 showing another structure which can deform transversely in the rolling direction of the foot.

FIG. 15 shows a transverse cross section of another structure of a sole 80 according to the invention and in which the passive zone 81 has a tapered extension 82 which continues under the shock absorbing element 83, with the extension 82 and the element 83 comprising the "active" zone 84, as above. A series of slits 85 made under the walking surface 87 constitutes the deformable structure 86 which promotes the transverse flexibility of the sole.

I claim:

1. Golf shoe wherein the sole is divided into two support zones for the plantar surface of the golfer's foot, with these two zones (3, 4; 19, 21; 25, 26; 35, 37; 50, 51; 81, 84) extending continuously from each other, and defining a first, "passive" zone (3, 21, 26, 35, 50, 81) which is made of a material having a certain hardness, with said passive zone constituting the main seating for the foot, and a second, "active" zone (4, 19, 25, 37, 51, 84) having a shock absorbing element (5, 22, 27, 37', 52, 71, 76, 83), whose constituent material is relatively softer than that of the passive zone, and with which is associated a walking surface having at least one zone whose structure can deform transversely to the longitudinal axis of the sole.

2. Golf shoe according to claim 1, wherein the active support zone (4, 19, 25, 37, 51, 84) covers at least the surface corresponding substantially to the zone of a golfer's foot going from the 3rd, 4th and 5th metatarsals to the respective first phalanges thereof.

3. Golf shoe according to claim 1 or 2, wherein the shock absorbing element (5, 22, 27, 52, 71, 76, 83) extends over a surface corresponding at least to that of the active zone.

4. Golf shoe according to claim 3, wherein the shock absorbing element (5, 22, 27, 52, 71, 76, 83) extends over a surface greater than that of the active zone.

5. Golf shoe according to claim 1 or 2, wherein the zone having a transversely deformable structure (6, 18, 86) of the walking sole extends over a surface corresponding at least to that of the active support zone.

6. Golf shoe according to claim 1 or 2, wherein the shock absorbing element (5, 22, 27, 52, 71, 76, 83) is inserted in the sole (2, 20, 31, 45, 70, 75, 80) continuously, on the side of the plantar surface of the foot, with the first passive support zone (4, 19, 25, 51, 84).

7. Golf shoe according to claim 5, wherein the deformable structure (6, 18, 86) is comprised of a series of grooves (6', 15, 29, 85) made in the sole on the side of the walking surface (11, 23', 31', 36, 57, 86).

8. Golf shoe according to claim 7, wherein the grooves (6') are essentially parallel to each other and to the longitudinal axis of the sole (2).

9. Golf shoe according to claim 7, wherein the grooves (15) are sinuous and define at least one circle arc curve the ends of which face the left outer edge (16) of the sole (17).

10. Golf shoe according to claim 1 or 2, wherein the deformable structure (6, 86) is comprised of a tapered extension (9, 38, 82) of the passive support zone (3, 35, 81), constituting the walking sole which extends under the shock absorbing element (5, 37', 83).

11. Golf shoe according to claim 1 or 2, wherein the sole (55) comprises an inclined plane (59) on the outer edge thereof (58), and this inclined plane is secant to the walking surface (57) of the sole.

12. Golf shoe according to claim 1 or 2, wherein the shock absorbing element (71, 76) extends longitudinally at least into a zone approximately between the position of the 3rd, 4th and 5th first phalanges of the foot, and the heel (73, 78).

13. Golf shoe according to claim 1 or 2, wherein the thickness of the shock absorbing element (22, 27, 52) is constant in the active support zone (19, 25, 51).

14. Golf shoe according to claim 1 or 2, wherein the shock absorbing element (5, 71, 76, 83) comprises a thickness which tapers towards the passive support zone (3, 81), from the outer edge of the active support zone (4, 84).

15. Golf shoe according to claim 1 or 2, wherein the sole (2, 17, 20, 31, 39) has a general transverse section in which the plantar surface of the foot is parallel to the lower surface (11, 23, 28, 36) (or walking surface) which comes into contact with the ground.

16. Golf shoe according to claim 1 or 2, wherein the sole (45, 55, 80) has a general transverse section in which the plantar surface of the foot is substantially inclined with respect to the lower surface (47, 57, 87) (or walking surface) which comes into contact with the ground, with the thickness of the sole increasing from the inside towards the outside of the foot.

17. Golf shoe according to claim 1 or 2, wherein the sole (60) has a transverse section in which the position of the plantar surface of the foot varies progressively from the heel to the front of the foot, from a parallel position (61) to an inclined position (63) with respect to the walking surface (62).

18. Golf shoe according to claim 1 or 2, wherein the walking surface (11, 23', 31', 36, 53, 57) of the sole (2, 20, 31, 39, 45, 55) is provided with a certain number of spikes (10, 24, 30).

19. Golf shoe according to claim 18, wherein the spikes are attached to the walking surface of the sole.

20. Golf shoe according to claim 18, wherein the spikes are unitary with the outsole (23).

21. Golf shoe according to claim 19, wherein the number of spikes (10, 24, 30) is greater in the part of the sole corresponding to the active support zone (4, 19, 25) than in the passive support zone.

* * * * *